US008215062B2

(12) United States Patent
Sakamoto

(10) Patent No.: US 8,215,062 B2
(45) Date of Patent: Jul. 10, 2012

(54) AIR-FLOATING-TYPE BASE ISOLATION DEVICE WHICH USES A SLIDING EXPANDING PIPE SHIELDING MATERIAL

(75) Inventor: Shoichi Sakamoto, Ibaraki Pref (JP)

(73) Assignee: Menshin Jyutaku Limited (JP)

( * ) Notice: Subject to any disclaimer, the term of this patent is extended or adjusted under 35 U.S.C. 154(b) by 44 days.

(21) Appl. No.: 12/332,971

(22) Filed: Dec. 11, 2008

(65) Prior Publication Data

US 2009/0158676 A1 Jun. 25, 2009

(30) Foreign Application Priority Data

Dec. 19, 2007 (JP) ..... 2007-341845

(51) Int. Cl.
*E04B 1/34* (2006.01)
*E04G 11/04* (2006.01)
*E04H 15/20* (2006.01)

(52) U.S. Cl. ..... 52/2.13; 52/167.4

(58) Field of Classification Search ..... 52/2.11, 52/2.13, 2.14, 2.15, 2.19, 2.22, 2.23, 167.1, 52/167.4, 167.5, 167.6, 167.7, 167.8, 167.9, 52/2.18, 703, 710, 712, 292, 293; 405/289, 405/290, 132, 135, 141, 142, 143, 144, 146, 147, 152; 454/169
See application file for complete search history.

(56) References Cited

U.S. PATENT DOCUMENTS

| | | | | | |
|---|---|---|---|---|---|
| 3,345,824 | A * | 10/1967 | Turzillo | ..... | 405/225 |
| 3,371,986 | A * | 3/1968 | Brown | ..... | 422/118 |
| 4,072,015 | A * | 2/1978 | Morrell et al. | ..... | 405/289 |
| 4,074,474 | A * | 2/1978 | Cristy | ..... | 52/2.11 |
| 4,191,496 | A * | 3/1980 | Becker | ..... | 405/229 |
| 4,988,237 | A * | 1/1991 | Crawshaw | ..... | 405/229 |
| 5,833,398 | A * | 11/1998 | LeNormand | ..... | 405/229 |
| 2004/0163333 | A1 * | 8/2004 | Whittaker et al. | ..... | 52/126.5 |

* cited by examiner

*Primary Examiner* — William Gilbert
*Assistant Examiner* — Theodore Adamos
(74) *Attorney, Agent, or Firm* — Ostrolenk Faber LLP

(57) ABSTRACT

An air-floating-type base isolation system having a plurality of air chambers defined and surrounded by a sliding expanding pipe shielding material. A groove in one plate receives a sliding expanding pipe of shielding material made of airtight material. A plurality of air pressure chambers are defined by placement of the grooves and shielding material at selected locations in the plate, so that the top plate can be allowed to float horizontally by adjustment of the pressure in the air pressure chambers, regardless of the position of the center of gravity of the building.

6 Claims, 6 Drawing Sheets

AIR-FLOATING-TYPE BASE ISOLATION DEVICE WHICH USES A SLIDING EXPANDING PIPE SHIELDING MATERIAL

BACKGROUND OF THE INVENTION

The present invention relates to an air-floating-type base isolation system in which a bottom plate and a top plate constituting the foundations of a building are both used as part of an air pressure chamber, allowing the top plate to float directly above the bottom plate.

PRIOR ART

Known air-floating-type base isolation devices use a plate-type airtight material in order to maintain air pressure in an air pressure chamber. But, it is difficult to fit the airtight material inside the top plate and bottom plate because of the nature of the construction and checking, maintenance operations involved. Therefore, the airtight material is often only fitted to the outside and in a region which can be reached by hand from the outside. This means that the air pressure chamber is usually only provided around the periphery of a building. Problems may arise in terms of inclination due to the location of the center of gravity of the building.

SUMMARY OF THE INVENTION

The present invention has an object of resolving the problems described above, and it aims to facilitate construction and make the checking and maintenance operations easier, while also allowing horizontal floating, wherever the center of gravity of a building lies.

In order to resolve the problems with known systems, internal operations are dispensed with when the top plate is constructed. This is done by prefabricating a groove into one plate, preferably the top plate. A sliding expanding pipe shielding material made of airtight material is inserted into the groove. The material is elastic and acts as an airtight material. The inside of the sliding expanding pipe shielding material is a cavity. Air is injected under pressure into the sliding expanding pipe shielding material, thereby expanding the expanding pipe shielding material so that an airtight effect between the plates is produced. The airtight material is disposed over at least one of the plates to define and enclose a region which becomes an airtight chamber due to the expansion of the shielding material.

The present invention not only makes operations to fit airtight material inside either of the plates unnecessary, it also makes it possible to allow the building to float horizontally during an earthquake by adjustment of the pressure in the air pressure chambers, even if the center of gravity of the top plate and the center of gravity of the building are different. The invention enables a plurality of air pressure chambers to be formed by a plurality of grooves or other path guides for the shielding material, permitting the shielding material to pass beneath the top plate and to surround, define and cause the air pressure chambers and preferably a plurality thereof to be formed.

DESCRIPTION OF AN EMBODIMENT OF THE INVENTION

Figure 1:
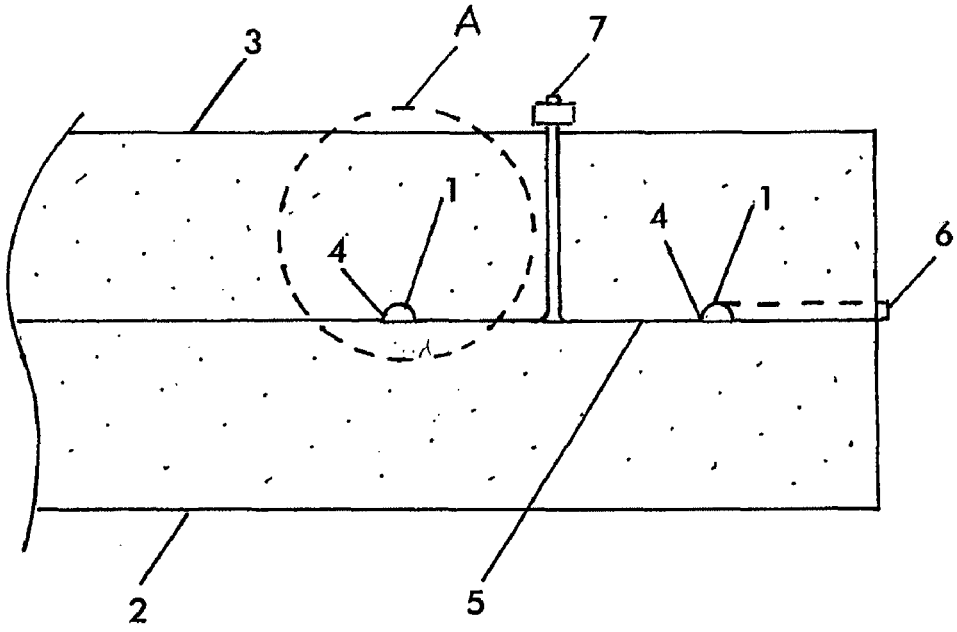
FIG. 1 is a side view in cross section of a fragment of an installation of the invention before air is delivered to its sliding expanding pipe shielding material and to its air pressure chamber and FIG. 1A is an enlarged view of a fragment of FIG. 1.
Figure 1A:
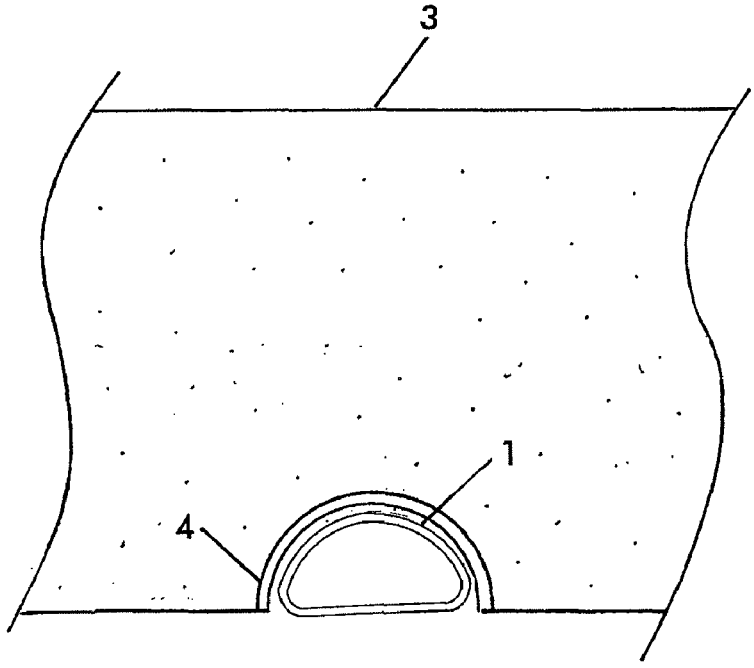
Figure 1B:
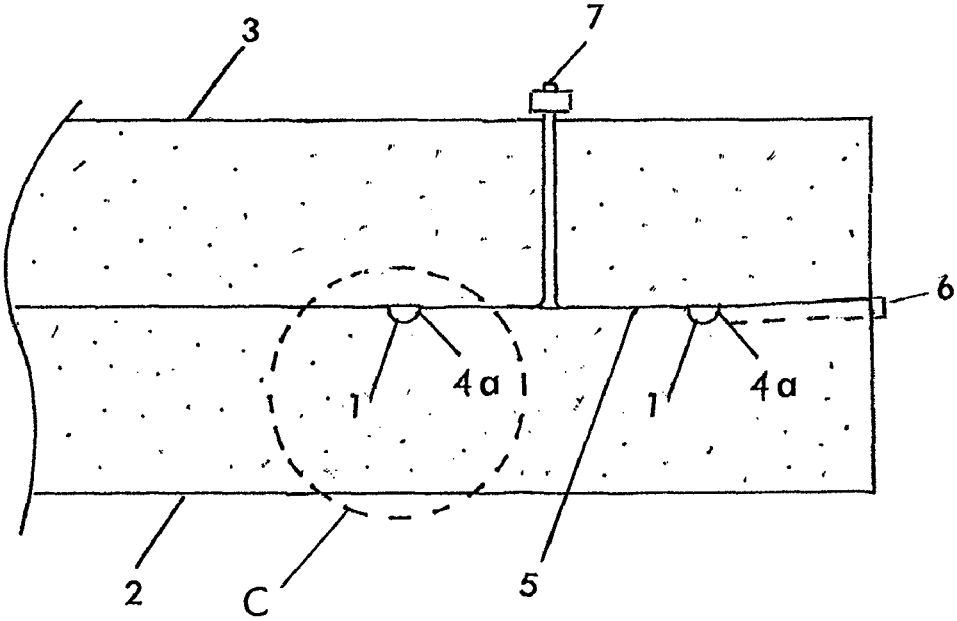
FIG. 1B is a side view in cross section of a fragment of an installation of the invention before air is delivered to its sliding expanding pipe shielding material and to its air pressure chamber and FIG. 1C is an enlarged view of a fragment of FIG. 1B.
Figure 1C:
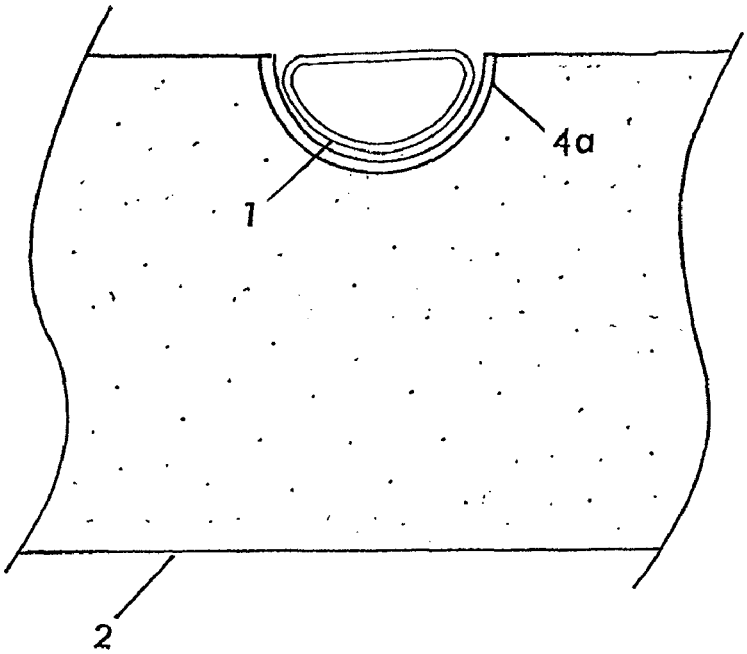
Figure 5:
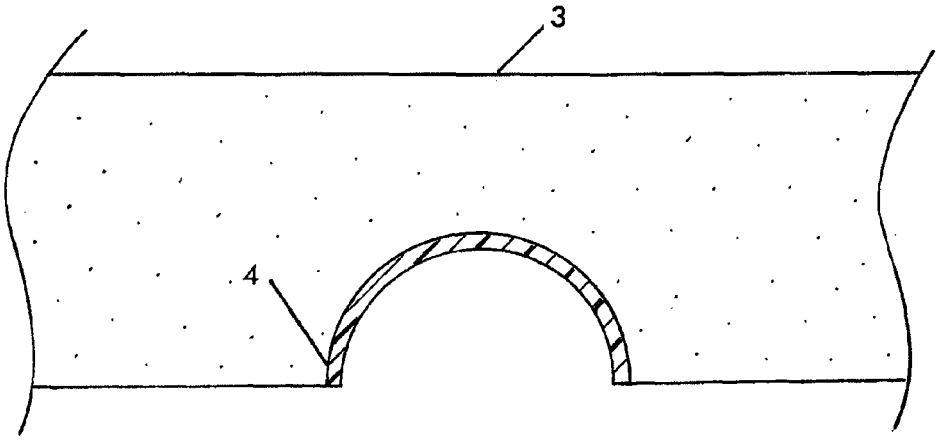
FIG. 5 is a view in cross section of a plate to receive the material.

As shown in FIGS. 1A and 5, a groove 4 is formed in the underside of a top plate 3 for receiving the insertion of the sliding expanding pipe shielding material 1 which is made of airtight material. The material has an enclosed expandable tubular form. This embedded groove 4 has a polyvinyl chloride or similar pipe in it. The groove has a semi-circular cross section, which is slightly wider than the shielding material. When the groove 4 is set in concrete, the inside of the groove forms a cavity. The groove or grooves may be formed anywhere over the area of the plate 3, enabling the below described chambers 5 to be provided over as much of the area of the plate as desired. Although the grooves are shown formed in the top plate surface opposing the bottom plate, they may be formed in the top of the bottom plate. FIGS. 1B and 1C show a groove 4*a* formed in the top of the bottom plate 2 with the sliding expanding pipe shielding material 1 inserted in the groove 4*a*. Other path guides for the material 1 may be provided, besides grooves.

The tubular sliding expanding pipe shielding material 1 is inserted from a sealed material insertion port. Use may be made of a guiding cord, or the like, which has been installed beforehand, to enable the insertion.

Figure 3:
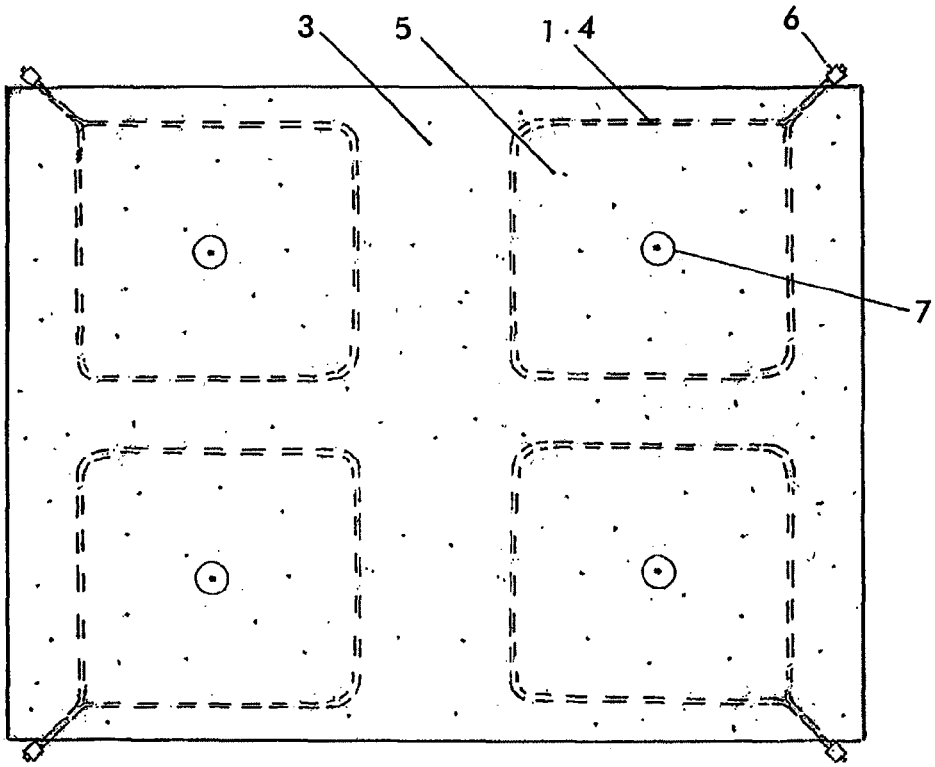
FIG. 3 is a plan view of a building plate showing an example in which sliding expanding pipe shielding material according to the present invention is in place.

FIG. 3 shows an exemplary embodiment, in a plan view of the bottom of a plate 3. A plurality of four airtight chambers 5 are defined. Each is defined by a separate groove 4 and shielding material 1 in the groove. The number, shapes and placement of chambers 5 is a matter of choice for a particular structure and location.

Once the insertion of the material 1 in a groove 4 is complete, the end of the sliding expanding pipe shielding material 1 may be fitted with an air injection port 6, as seen in FIG. 3.

Figure 2:
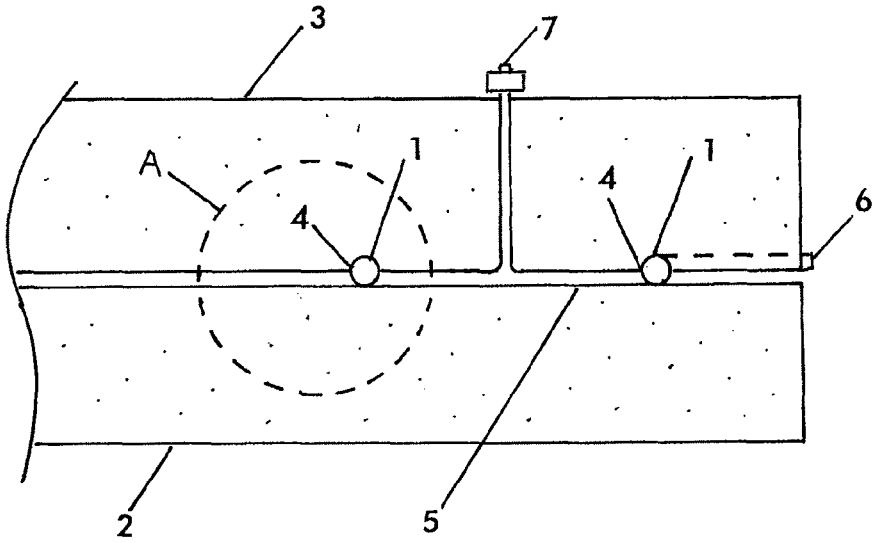
FIG. 2 is a view in cross section corresponding to FIG. 1 in which the sliding expanding pipe shielding material 1 has been expanded by air and the top plate is floating due to the compressed air pressure chamber.
Figure 2A:
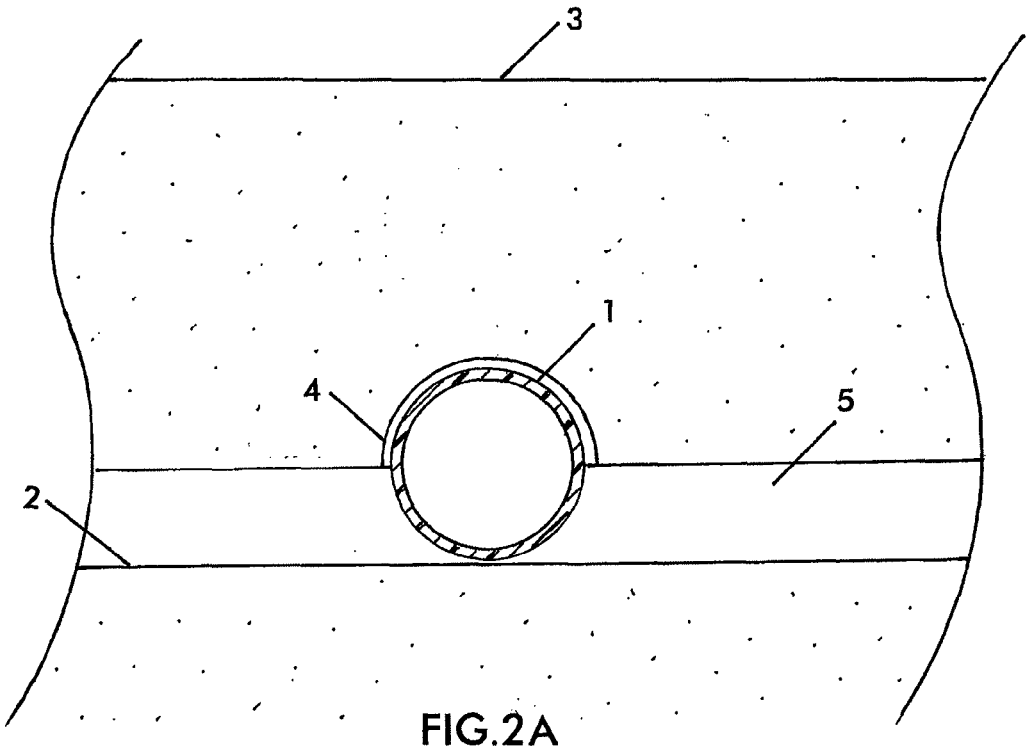
FIG. 2A is an enlarged view of a fragment of FIG. 2.
Figure 4:
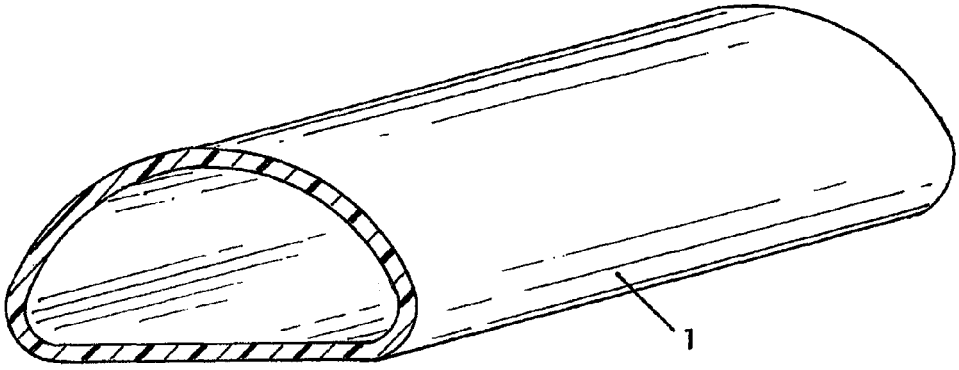
FIG. 4 shows a length of the sliding expanding pipe shielding material.

As shown in FIGS. 3 and 4, the sliding expanding pipe shielding material 1 is caused to expand by injecting high-pressure compressed air from the air injection port 6 into the tubular sliding expanding pipe shielding material 1, the inside of which forms a cavity. The expanded material 1 forms an airtight seal between the plates 2 and 3 and, as shown in FIGS. 2 and 2A, raises the plate 3 to define the respective chamber 5.

Low-pressure compressed air is injected through an air injection port 7 into each air pressure chamber 5 at the same time. As the air pressure in the air pressure chamber 5 rises, the top plate 3 floats, and the sliding expanding pipe shielding material 1 expands at the same time, causing the top plate 3 to rise while air-tightness is maintained.

The shaking produced during an earthquake is transferred to the bottom plate 2. But, friction resistance between the plates is lessened because the upper plate 3 is floating, so that the shaking is not readily transferred to the top plate 3. As a result, the building built on top of the top plate 3 is not readily subjected to the shaking caused by the earthquake.

Furthermore, the building can be allowed to float horizontally by adjustment of the respective pressures in the plurality of air pressure chambers 5, even if the building does not float horizontally due to the bias of the center of gravity thereof.

Figure 6:
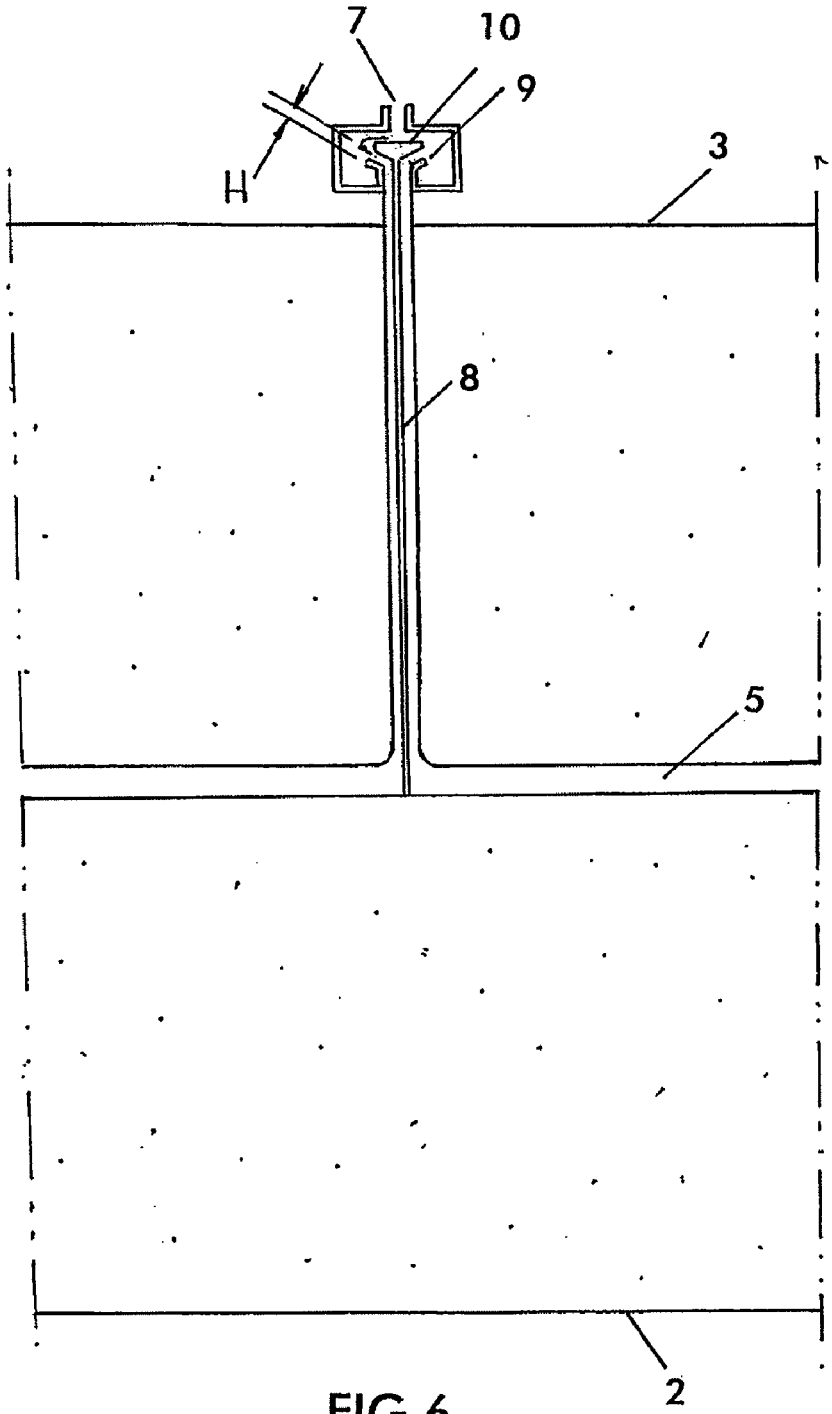
FIG. 6 shows an example of an air pressure adjuster for the pressure chamber.

FIG. 6 is an example of an air pressure adjuster provided in the air injection port 7. A stopper rod 8 runs into the lower plate 2, whereby a stopper head 10 is pushed up and a gap H with a stopper 9 is produced. Compressed air is injected therein. When the top plate 3 is floating by more than the length of the stopper rod 8, the stopper head 10 and stopper 9 come into close contact, and the supply of compressed air is stopped, so that excessive floating of the top plate 3 is restrained, and the building is kept horizontal.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed:

1. An air-floating base isolation system comprising:

a bottom plate, and a top plate, which is at a foundation of a building, on the bottom plate, wherein the plates define boundaries of at least one air pressure chamber, boundaries of the air pressure chamber being defined by a sliding, expandable, pipe shaped shielding material having a cavity inside of the shielding material, the shielding material being disposed between the top and bottom plates and inserted into path guides in the top plate or in the bottom plate, the top and bottom plates and the shielding material defining and forming all boundaries of the air pressure chamber as a closed and airtight chamber between the top and bottom plates and outside of the shielding material, the pipe shaped shielding material being expandable into contact with the plates to prevent an air leak past the shielding material;

the top plate being caused to float above the bottom plate by air pressure in the air pressure chamber, thereby achieving a base isolation effect and allowing the building to float horizontally, wherein when the shielding material, which is inserted into the path guides, is not inflated, the top and bottom plates sit flush against each other.

2. The system of claim 1, wherein the pipe shaped shielding material is placed between the top and bottom plates to define a plurality of the air pressure chambers each defined by the shielding material, a respective pressure in each of the air pressure chambers being adjustable.

3. The system of claim 1, wherein the path guides are grooves.

4. The system of claim 3, further comprising a first air inlet to the shielding material and second air inlet for air pressure in the chamber.

5. The system of claim 1, wherein the shielding material has an enclosed tubular form.

6. An air-floating base isolation system comprising:

a bottom plate, a top plate on the bottom plate, wherein the plates define an air pressure chamber to enable the top plate, which is at a foundation of a building, to float by means of air pressure, and a conduit passing through the top plate, the conduit conducting air into the air pressure chamber, the air pressure chamber being defined by a sliding, expandable, pipe shaped shielding material having a cavity inside of the shielding material, the shielding material being disposed between the plates and inserted into path guides in the top plate or in the bottom plate along a path which defines and forms the air pressure chamber as a closed and airtight chamber between the plates, the air pressure chamber being outside of the shielding material, the pipe shaped shielding material being expandable into contact with the plates to prevent an air leak past the shielding material;

the top plate being caused to float above the bottom plate by air pressure in the air pressure chamber, thereby achieving a base isolation effect and allowing the building to float horizontally, wherein when the shielding material, which is inserted into the path guides, is not inflated, the top and bottom plates sit flush against each other.

* * * * *